United States Patent [19]

Toda et al.

[11] Patent Number: 5,015,289

[45] Date of Patent: May 14, 1991

[54] METHOD OF PREPARING A METAL BODY BY MEANS OF INJECTION MOLDING

[75] Inventors: Takuo Toda; Masao Tsuda, both of Hiroshima, Japan

[73] Assignee: King Invest Co., Ltd., Hiroshima, Japan

[21] Appl. No.: 565,976

[22] Filed: Aug. 10, 1990

[30] Foreign Application Priority Data

Feb. 2, 1990 [JP] Japan ..... 2-26319

[51] Int. Cl.[5] ..... B22F 1/00

[52] U.S. Cl. ..... 75/229; 75/243; 419/11; 419/24; 419/36; 419/37

[58] Field of Search ..... 419/11, 29, 36, 37; 75/229, 293

[56] References Cited

U.S. PATENT DOCUMENTS 4,699,763 10/1987 Sinharoy et al. ..... 419/11
4,919,719 4/1990 Abe et al. ..... 419/11
4,921,665 5/1990 Klar et al. ..... 419/11
4,964,907 10/1990 Kiyota et al. ..... 419/11

*Primary Examiner*—Stephen J. Lechert, Jr.
*Attorney, Agent, or Firm*—McAulay, Fisher, Nissen, Goldberg & Kiel

[57] ABSTRACT

A manufacturing method for a metal body by means of injection molding that comprises the steps of mixing and kneading a metal powder with short fibers such as metallic fibers, carbon fibers and an organic binder, injection-molding the kneaded mixture to form a green body, removing the organic binder from the green body, and sintering the brown body. The short fibers are added in an amount ranging from about 0.1 to 20 wt. % against 100 wt. % of the metal powder and have a melting point of at least 350° C., and at the time of sintering the fibers not less than 30 vol. % become fused and then integrated with the metal. The short fibers act as a reinforcement, strengthening the brown body as well as preventing deformation and cracking of the green body during debinding.

14 Claims, 1 Drawing Sheet

METHOD OF PREPARING A METAL BODY BY MEANS OF INJECTION MOLDING

BACKGROUND OF THE INVENTION

1. Field of the Invention

This invention relates to preparing metal bodies by injection molding, more particularly, the invention pertains to a method for preparing a metal body having improved mechanical properties.

2. Description of the Prior Art

The metal body of the type described in this invention is manufactured by kneading a metal powder with an organic binder, injection-molding the kneaded mixture to form a green body, removing the organic binder from the green body to form a brown body, and sintering the brown body. The method described above is superior in that it allows an arbitrary selection of the shape of the metal body, that it is suitable for mass production, and that the sintered product has excellent physical and mechanical properties because of the improved compaction obtained by the use of fine powder. However, a substantial amount of organic binder must be used relative to the metal powder amount in order to give plasticity to the metal powder and prevent deformation of the green body molded into a prescribed shape. This entailed a troublesome step of removing the organic binder from the green body, i.e., debinding the green body, over a prolonged period of time at a very gradual temperature gradient.

As a known method, Japanese Unexamined Published Patent Application No. 61-204301 discloses a method wherein short fibers of synthetic resins such as, polypropylene, nylon and acrylic in the range of from 10 to 40 μm in diameter and from 0.3 to 2 mm in length are kneaded with a metal powder and an organic binder. In this method, the short fibers are used to prevent deformation of the green body after molding, so that the amount of the organic binder can be reduced and debinding facilitated. Thus, this method is superior in that no cracking occurs in the brown body after debinding the green body to thereby obtain a sintered body with high quality and high strength. The short fibers used in this method are, however, of a synthetic resin, which become softened during debinding the green body with temperatures reaching as high as 350° C. and eventually become melted. This method is defective because of insufficient performances in preventing deformation of the green body during debinding and in maintaining the strength of the brown body after debinding.

SUMMARY OF THE INVENTION

The present invention aims at providing a method of preparing a metal body by means of injection molding which is capable of increasing the rate of temperature elevation at the time of debinding the green body while preventing deformation and cracking of the green body under debinding. Another object of this invention is to provide a method of preparing a metal body which strengthens the brown body after debinding so as to facilitate the handling of the brown body. Still another object of this invention is to provide a method of preparing a metal body without deteriorating the mechanical properties of the metal body after sintering.

To achieve these objects, this invention describes a method which comprises the steps of kneading a metal powder with short fibers and an organic binder, forming a green body by injection-molding the kneaded mixture, removing the organic binder from the green body to form a brown body, and sintering the brown body.

The present invention's method is characterized in that the above short fibers are added in an amount ranging from about 0.1 to 20 wt. % against 100 wt. % of the metal powder and have a melting point of about at least 350° C., and that at the time of sintering the short fibers, not less than 30 vol. %, become fused with the metal powder to thereby integrate with the metal.

DESCRIPTION OF THE PREFERRED EMBODIMENT

Figure 1:
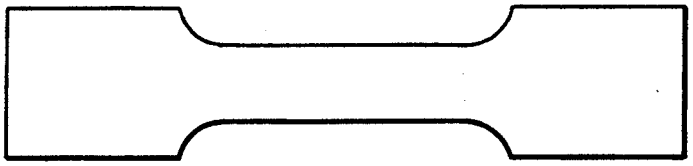
FIG. 1 is a plan view of a metal mold of tensile test pieces used in the examples and comparative examples.

Powder of carbonyl iron, carbonyl nickel, austenitic stainless steel such as SUS 304 (Cr 18% - Ni 8%) and SUS 316 (Cr 18% - Ni 12% - Mo 2.5%), as well as any other metal powders usually used in the metal injection molding may be used as the metal powder in this invention. The metal powder preferably has a mean particle size of 20 μm or less. Ultrafine powders having the particle size of 10 μm or less are particularly preferable because of their excellent fluidity and ease in injection molding. Coarse powders having the particle size of 20 μm or more are not preferred because of inferior fluidity and difficulty in injection molding.

Since it is essential that the short fibers for this invention maintain their fibrous form at the time of debinding, the short fibers are made of a heat resistant material, whose melting point is 350° C. or higher. In order to maintain the mechanical properties of the metal body after sintering, at the time of sintering the short fibers not less than 30 vol. % become fused together with the metal powder and then integrated with the metal. The short fibers can be comprised of metallic fibers, carbon fibers, or any mixture thereof. In particular, the metallic fibers having the same chemical composition as that of the metal powder are preferable since the metal body after sintering will hardly undergo any deterioration in its mechanical properties.

The short fiber should preferably have a diameter of about 20 μm or less, and the length should be in the range of from about 2 mm to 10 mm. If the fiber diameter exceeds 20 μm, injection molding becomes difficult, and particularly in the case of carbon fiber, dispersion of carbon into the metal becomes undesirably difficult. If the length of the short fiber is less than 2 mm, the effect of reinforcing the green body is or the brown body lowered, whereas if the length of the fiber is 10 mm or longer it is defective in that the fibers become entangled and concentrated at certain points within the metal body. The short fibers are added in an amount ranging of from about 0.1 to 20 wt. % depending on the specific gravity thereof against 100 wt. % of the metal powder. If the addition is less than 0.1 wt. %, the short fibers will not effectively act as a reinforcement for the green body or the brown body. On the other hand, if the amount exceeds 20 wt. %, injection molding becomes difficult.

As the organic binder for this invention, a binder based polymer such as polyethylene, polystyrene, and polyamide, or paraffinic wax can be employed. The organic binder is added in an amount of from about 6 to 15 wt. % against 100 wt. % of the metal powder. If the metal powder has a large specific surface, the organic binder must be increased; if the metal powder has a small specific surface, the organic binder must be decreased. If less than 6 wt. % is added, the fluidity deteriorates making the injection molding difficult. If it exceeds 15 wt. %, cracking and deformation tend to occur in the brown body.

In the present method, the metal powder is kneaded with the short fibers and the organic binder. The kneaded mixture is then subjected to injection molding using a predetermined metal mold. The injection molding is conducted preferably at pressures ranging of from about 400 to 2000 kg/cm$^2$ and with temperatures of from about 120° to 160° C. If the pressure is below 400 kg/cm$^2$, it is too low for the material to flow, whereas if it exceeds 2000 kg/cm$^2$, the mold is easily broken or damaged. If the temperature is below 120° C., the material viscosity becomes too high for the material to flow, while if it exceeds 160° C., defects such as blowholes due to decomposition of the binder are likely to occur.

The organic binder is removed from the thus injection-molded green body by decomposing and vaporizing the same for debinding the green body. According to this invention, debinding is conducted by raising the temperature from about room temperature to 350° C. at the range of from about 10° to 200° C./hr which is faster than the rate employed in the prior art, since the green body contains the short fibers for retaining its shape. The thinner the green body, the higher the rate of temperature increase can be for debinding. The debinded green body, i.e. the brown body, is subjected to sintering under a vacuum. Sintering is conducted with temperatures of from about 1100° to 1500° C. for from 0.5 to 4 hours, at which temperatures the metal particles become dispersed and closely adhered to each other.

When the green body obtained by the injection-molding of the uniformly kneaded mixture of the metal powder, short fibers and organic binder is subjected to debinding, the short fibers serve as a reinforcement to thereby prevent deformation and cracking of the green body under debinding. The short fibers also work to retain the shape of the brown body, so that the brown body can be carried to a sintering furnace easily without spoiling the shape.

During sintering, the short fibers become fused together with the metal powder and then integrated with the metal. In the case of carbon fibers, in particular, carbon lowers the melting point of the metal, so that the effect of sintering on the metal improves. Moreover, since carbon combines with the metal, the mechanical properties of the metal body after sintering remain intact.

The present invention will now be described in more detail referring to preferred examples and comparative examples.

EXAMPLE 1

100 g of SUS 304 metal powder of 9 μm mean particle size was thoroughly mixed 3 g of SUS with 304 short fibers, having a mean fiber diameter of 8 μm and a length of 5 mm. The mixture was added to 2.93 g of ethylenevinyl acetate copolymer, 3.12 g of polybutyl methacrylate, 3.71 g of paraffin wax, and 0.74 g of dibutyl phthalate as organic binders, and charged into a kneader which was heated to 150° C. The mixture was thoroughly kneaded in the kneader under pressure for 30 minutes so as to have viscosity suitable for injection molding.

The kneaded mixture was then subjected to injection molding at 700 kg/cm$^2$ and 150° C. to obtain a green body similar to the desired metal body in shape. The green body was placed in a debinding furnace, heated at 15° C./hr from room temperature to 320° C. under atmospheric pressure, and maintained for 1 hour at 320° C. to remove the organic binder therefrom by decomposing and vaporizing the binder. The debinded green body, i.e. the brown body, was then left standing in the furnace to cool. The residual binder in the brown body was measured to be 0.52 g against the initial total amount of 10.5 g.

The thus obtained brown body was placed in a sintering furnace, heated from room temperature to 1350° C. at 300° C./hr under the vacuum pressure of $10^{-3}$ Torr, and maintained at 1350° C. for 1 hour to thereby sinter the brown body. After sintering the sintered body was cooled in the furnace to obtain the desired metal body of SUS 304.

COMPARATIVE EXAMPLE 1

A metal body of SUS 304 was obtained in the same manner as in Example 1 except for the omission of the short fibers used in Example 1.

EXAMPLE 2

To 4 g of nickel powder of 3 μm mean particle size and 96 g of carbonyl iron powder of 5 μm mean particle size was added and thoroughly mixed 0.5 g of short carbon fibers of 7 μm mean fiber diameter and 5 mm mean length (Toray Industries, Inc., trademark "TORAYCA"). The resultant mixture was added to 2.79 g of ethylenevinyl acetate copolymer, 2.98 g of polybutyl methacrylate, 3.53 g of paraffin wax, and 0.70 g of dibutyl phthalate, and kneaded similarly as in Example 1.

The resultant mixture was injection-molded similarly as in Example 1 to obtain a green body similar to the desired shape metal body. The green body was placed in the debinding furnace of Example 1, heated from room temperature to 250° C. at 10° C./hr under atmospheric pressure, maintained for 1 hour at 250° C. to remove the organic binder therefrom by decomposing and vaporizing the binder, and was left standing in the furnace to cool. The residual binder in the brown body was measured to be 4 g against the initial total amount of 10 g.

The resultant brown body was placed in the sintering furnace, heated from room temperature to 1300° C. at 400° C./hr under the vacuum pressure of $10^{-3}$ Torr, and maintained at 1300° C. for 30 minutes to sinter the brown body. The sintered body was left standing in the furnace to cool, and the desired metal body of Fe-Ni-C was obtained.

COMPARATIVE EXAMPLE 2

The sintered metal body of Fe-Ni was obtained similarly as in Example 2 except that the carbon fibers were not used.

When compared with the brown body obtained in Comparative Examples 1 and 2 where no short fibers were used, the brown body in Examples 1 and 2 manifested very little deformation and cracking. Thus, the addition of the short fibers addition was highly effective.

After the SUS 304 metal body of Example 1 was subjected to electrolytic etching in a 10% oxalic acid solution, and the Fe-Ni-C metal body of Example 2 in Nital, metallurgical microscopic observation was conducted to reveal that the SUS 304 fibers were sintered together with the SUS 304 powder, leaving no traces, and that the carbon fibers were substantially fused in the Fe-Ni metal body, although slight traces thereof were observed.

The relative density of the respective sintered bodies of the examples was measured using the Archimedean method. The tensile test was conducted on an Instron tester using 4 mm thickness test pieces obtained from the mold shown in FIG. 1. The hardness test was conducted using a Rockwell hardness testing machine. The results are shown in Table 1.

TABLE 1

| | Relative density (%) | Tensile strength ($kg/mm^2$) | Elongation (%) | Hardness (HRB) |
|---|---|---|---|---|
| Example 1 | 95 | 48.5 | 40.0 | 67.4 |
| Comparative Example 1 | 95 | 50.0 | 43.0 | 69.1 |
| Example 2 | 95 | 35.5 | 31.6 | 55.1 |
| Comparative Example 2 | 95 | 39.3 | 31.9 | 58.1 |

Table 1 clearly indicates that the sintered bodies of Examples 1 and 2 have high mechanical strengths suitable for industrial applications, which are slightly inferior to those of Comparative Examples 1 and 2.

What is claimed is:

1. In a method of preparing a metal body by means of injection molding wherein, a metal powder with short fibers and an organic binder, are mixed and kneaded, the kneaded mixture is injection molded to form a green body, the organic binder is removed from said green body to form a brown body, and the brown body is sintered, the improvement which comprises the short fibers have a melting point of about at least 350° C., are being added in an amount ranging from about 0.1 to 20 wt. % based on 100 wt. % of the metal powder, and such that at the time of sintering the shortened fibers, not less than 30 vol. % become fused with the metal powder and integrate with the metal.

2. The method of claim 1 wherein said short fibers are a mixture of metallic and carbon fibers.

3. The method of claim 1 wherein said metal powder has a mean particle size of about 20 μm or less.

4. The method of claim 1 wherein said metal powder has a mean particle size of about 10 μm or less.

5. The method of claim 1 wherein said short fibers have a diameter of about 20 μm or less and a length from about 2 mm to 10 mm.

6. The method of claim 1 wherein said organic binder is selected from the group consisting of polyethylene, polystyrene, polyamide, and paraffinic wax.

7. The method of claim 1 wherein said organic binder is present in an amount from about 6 to 15 wt. % based on 100 wt. % of the metal powder.

8. The method of claim 1 wherein said injection-molding is carried out at a pressure from about 400 to 2000 kg/cm2.

9. The method of claim 1 wherein said injection-molding is carried out at a temperature of from about 120° to 160° C.

10. The method of claim 1 wherein the organic binder is removed by heating the green body to the melting of the binder point.

11. The method of claim 1 wherein the organic binder is removed by heating the green body at a rate of from about 10° C. to 200° C./hr.

12. The method of claim 1 wherein the sintering is carried out at a temperature of from about 1100° to 1500° C.

13. The method of claim 1 wherein the sintering is carried out at a time from about 0.5 to 4 hours.

14. A sintered body formed by the process of claim 1.

* * * * *